US006599140B1

(12) United States Patent
Chen et al.

(10) Patent No.: US 6,599,140 B1
(45) Date of Patent: Jul. 29, 2003

(54) ELECTRICAL CONNECTOR ASSEMBLY HAVING A PLACEMENT MEMBER

(75) Inventors: XiaoLiang Chen, Kunsan (CN); WeiCheng Yu, Kunsan (CN); QiJin Hao, Kunsan (CN); Zhangjiang Ji, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/137,965

(22) Filed: May 2, 2002

(51) Int. Cl.[7] ..... H01R 13/44
(52) U.S. Cl. ..... 439/135; 439/940
(58) Field of Search ..... 439/135, 41, 940, 439/476.1, 477, 478, 148, 149

(56) References Cited

U.S. PATENT DOCUMENTS 4,396,245 A * 8/1983 Lane ..... 439/148
5,026,295 A * 6/1991 Fong et al. ..... 439/135
5,249,977 A * 10/1993 Tanaka et al. ..... 439/135
5,681,174 A * 10/1997 Correll, et al. ..... 439/135
5,688,133 A * 11/1997 Ikesugi et al. ..... 439/135
5,910,023 A * 6/1999 McHugh et al. ..... 439/41
6,015,305 A * 1/2000 McHugh et al. ..... 439/135
6,135,795 A * 10/2000 Ho et al. ..... 439/135
6,168,444 B1 * 1/2001 Wu et al. ..... 439/135
6,371,776 B1 * 4/2002 Li et al. ..... 439/135
6,439,901 B1 * 8/2002 Ji et al. ..... 439/135

* cited by examiner

*Primary Examiner*—Renee Luebke
*Assistant Examiner*—Felik O. Figueroa
(74) *Attorney, Agent, or Firm*—Wei Te Chung

(57) ABSTRACT

An electrical connector assembly includes a connector (1) and a placement, member (2) assembled on the connector to provide a vacuum suction surface. The placement member includes a main plate (20) having a substantially planar upper surface (200) and an opposite lower surface (201). A plurality of positioning legs (22) extends downwardly from the lower surface and adjacent to a pair of opposite edges of the main plate. Two U-shaped retaining portions (21) extend from another pair of opposite edges of the main plate. Each retaining portion has a beam (212) and a pair of projecting legs (210) extending downwardly from the beam. The pairs of projecting legs abut against the inner surfaces of connector sidewalls (31). The positioning legs fit in slots (310) defined in outer surfaces of the sidewalls.

7 Claims, 6 Drawing Sheets

ELECTRICAL CONNECTOR ASSEMBLY HAVING A PLACEMENT MEMBER

BACKGROUND OF THE INVENTION

1. Field of the Invention

The present invention generally relates to an electrical connector assembly, and more particularly to an electrical connector assembly having a placement member assembled thereon to provide a vacuum suction pick-up surface.

2. Description of Related Art

Vacuum suction mechanisms are well known in the electronic assembly art and are used for retrieving electronic components, such as connectors, from a supply source and transferring the component by applying negative air pressure to the component and placing the component on a printed circuit board in a preselected position for soldering. Generally, the vacuum suction mechanism comprises a suction nozzle. A connector is grasped by the suction nozzle and is robotically transferred to the position on the printed circuit board with great accuracy.

Most electrical connectors, however, are devoid of flat, solid surface suitable for being grasped by the suction nozzle. To overcome this problem, transfer or placement members having a flat, non-porous surface have been developed for attaching to connectors. Such connector placement members are described in the U.S. Pat. Nos. 5,688,133; 4,396,245; 5,249,977; and 5,681,174. These patents describe placement members designed for an electrical connector having two opposite sidewalls extending upward from a connector body. The placement members have a flat top surface suitable for being grasped by a vacuum suction nozzle and downwardly extending legs for engaging with the sidewalls of the connector body.

For example, FIGS. 4 and 5 show the placement cover of U.S. Pat. No. 5,688,133. The placement cover 8 is made of metallic material, is formed by stamping, and has a cover plate 80 with a flat top surface. Two pairs of resilient arms extend downwardly from each end of the cover plate 80. Each pair of arms has an outer engagement arm 81 and an inner engagement arm 82. The outer and inner arms 81, 82 are spaced apart from each other to define a receiving space 83. The dielectric housing 90 of connector 9 has a pair of opposing longitudinal sidewalls 901 and a center wall (not labeled). A pair of slots 902 are defined between the sidewalls 901 and the center wall. When the placement cover 8 is assembled on the connector 9, each space 83 receives a sidewall 901 of the connector housing 90 and the outer and inner arms 81, 82 abut against the outer and inner surfaces of the sidewalls 901. However, since the placement cover 8 of the '133 patent is made of metal, the shape and dimension of the outer and inner engagement arms 81, 82 must be precisely formed so that they mate with the connector reliably. The manufacturing method therefore, adds expense.

U.S. Pat. No. 6,439,901, which has the same assignee as the present invention, discloses a placement member made of a resilient dielectric material, as shown in FIG. 6. The placement member 7 is assembled on a connector 6 and has a pair of downwardly projecting legs 71 at each end thereof. A retaining foot 710 is formed at an end of each leg 71 for abutting against an inner surface of longitudinal sidewalls 61 of the connector 6. The manufacturing method of the placement member 7 is simple. However, since the placement member 7 has no positioning element, the placement member 7 may end up being positioned in any place along the longitudinal direction N. The precision of the robotic assembly, thereof, is reduced.

Hence, an electrical connector with an improved placement member is desired to overcome the above-mentioned disadvantages.

SUMMARY OF THE INVENTION

Accordingly, one object of the present invention is to provide an improved placement member with guiding, or positioning legs.

Another object of the present invention is to provide an electrical connector assembly having an improved placement member reliably and precisely assembled on an electrical connector.

In order to achieve the above-mentioned objects, an electrical connector assembly in accordance with the present invention comprises an improved placement member assembled on a connector. The placement member provides vacuum suction surface for vacuum placement mechanism to attach to. The placement member is made of a resilient insulative material and comprises a main plate, which has a substantially planar upper surface and an opposite lower surface, a plurality of positioning legs extending downwardly from said lower surface, and two U-shaped retaining portions extending from the two lateral edges of the main plate. Each retaining portion has a beam portion connecting with the edge of the main plate and a pair of projecting legs extending downwardly from ends of the beam. The pairs of projecting legs abut against the inner surfaces of the connector body and the positioning legs are positioned in slots on the outer surfaces of the connector sidewalls.

Other objects, advantages and novel features of the invention will become more apparent from the following detailed description when taken in conjunction with the accompanying drawings.

DETAILED DESCRIPTION OF THE INVENTION

Figure 1:
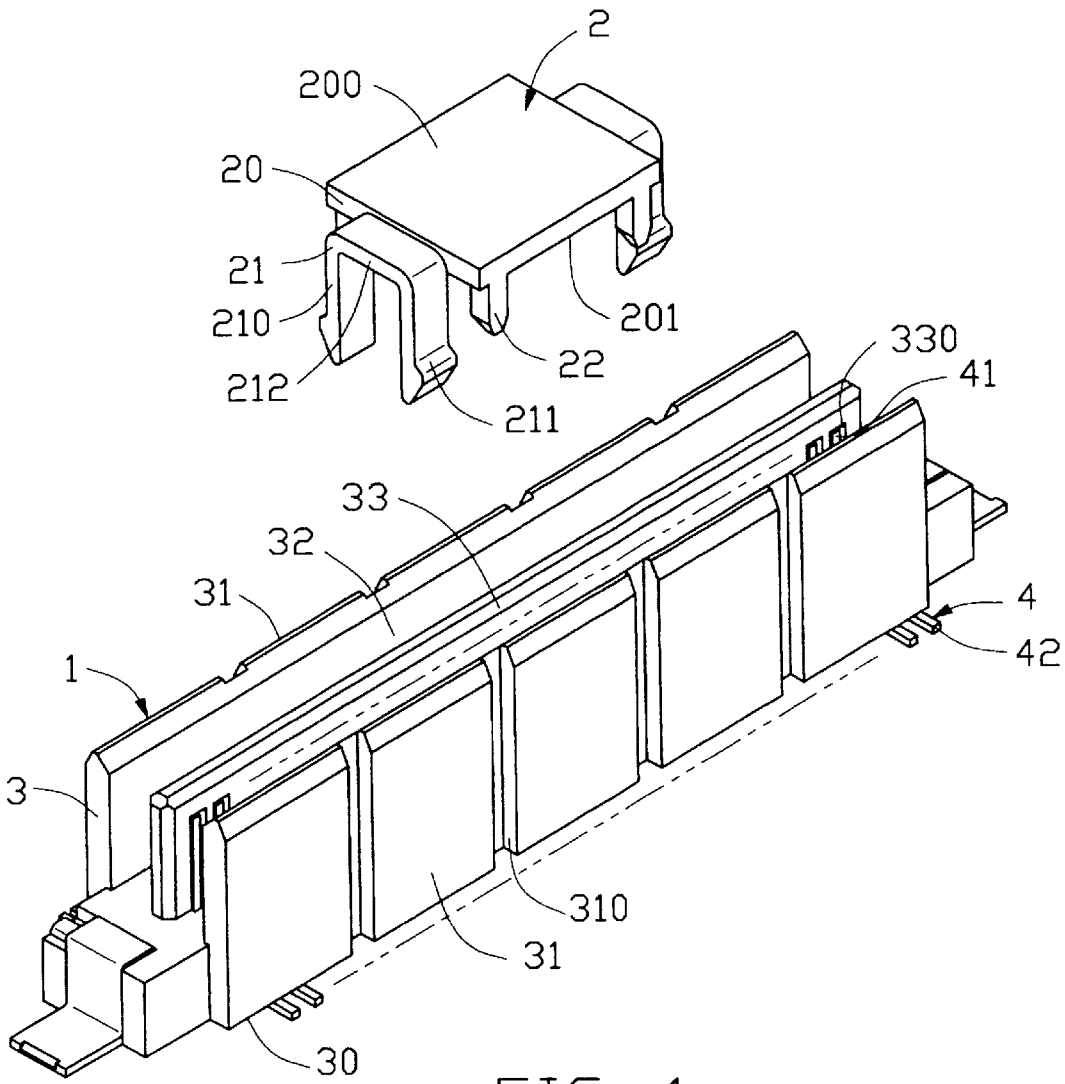
FIG. 1 is an exploded, perspective view of an electrical connector assembly having a placement member in accordance with the present invention.
Figure 2:
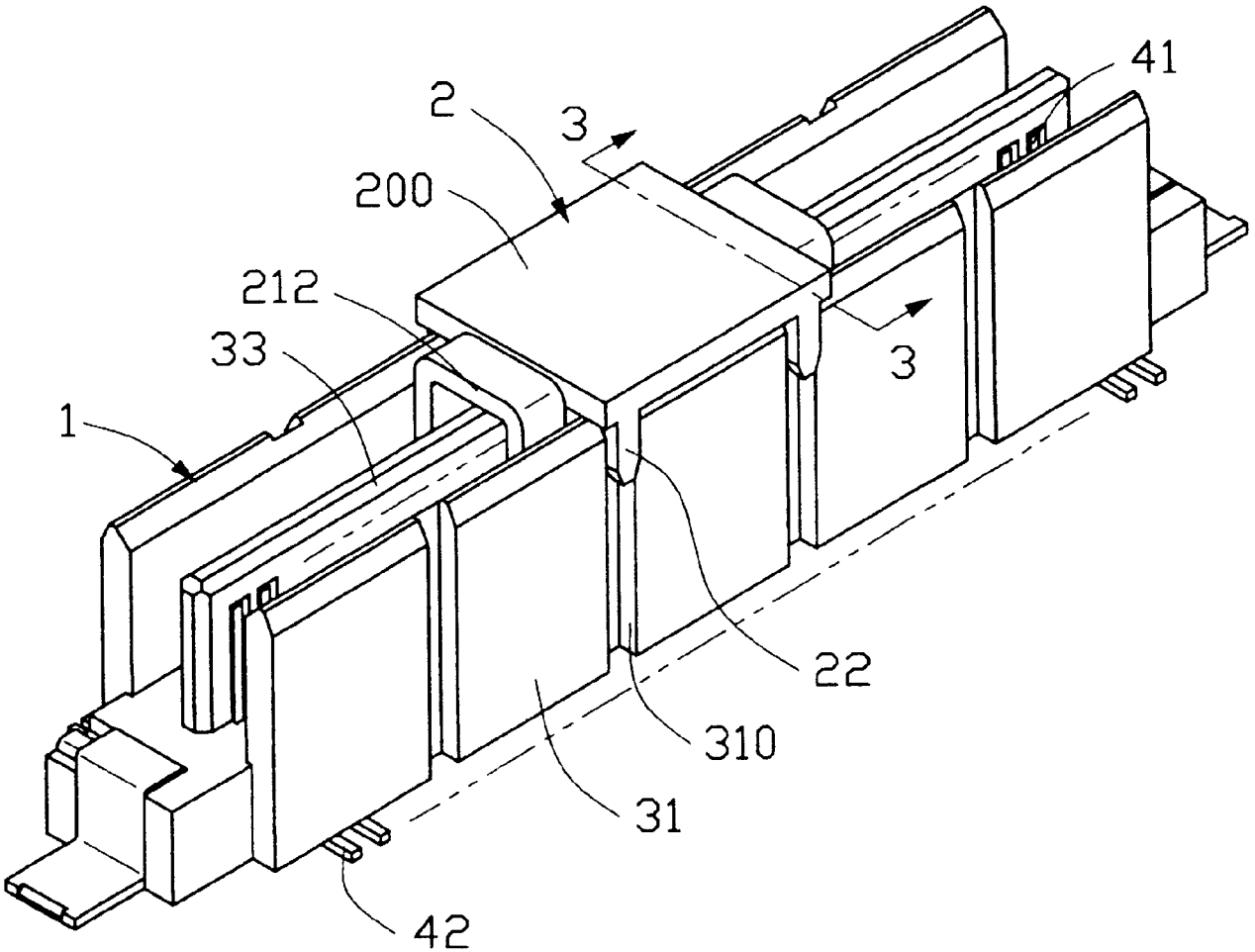
FIG. 2 is an assembled view of the electrical connector assembly shown in FIG. 1.
Figure 3:
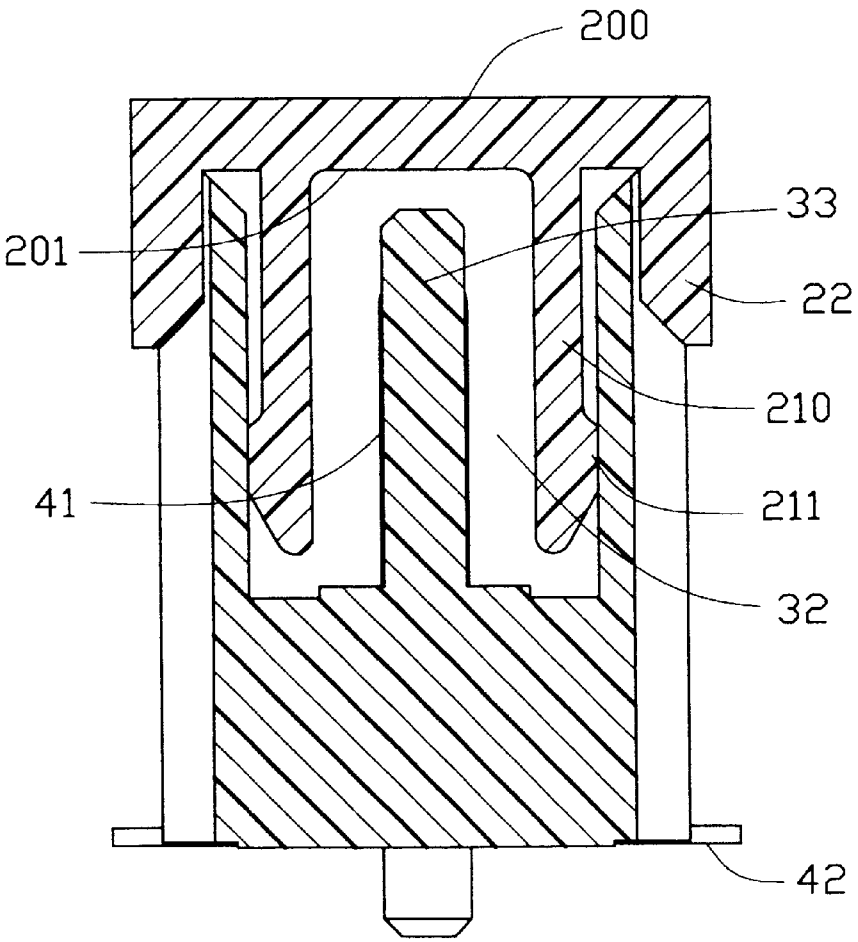
FIG. 3 is a cross sectional view of the electrical connector assembly taken along line 3—3 of FIG. 2.
Figure 4:
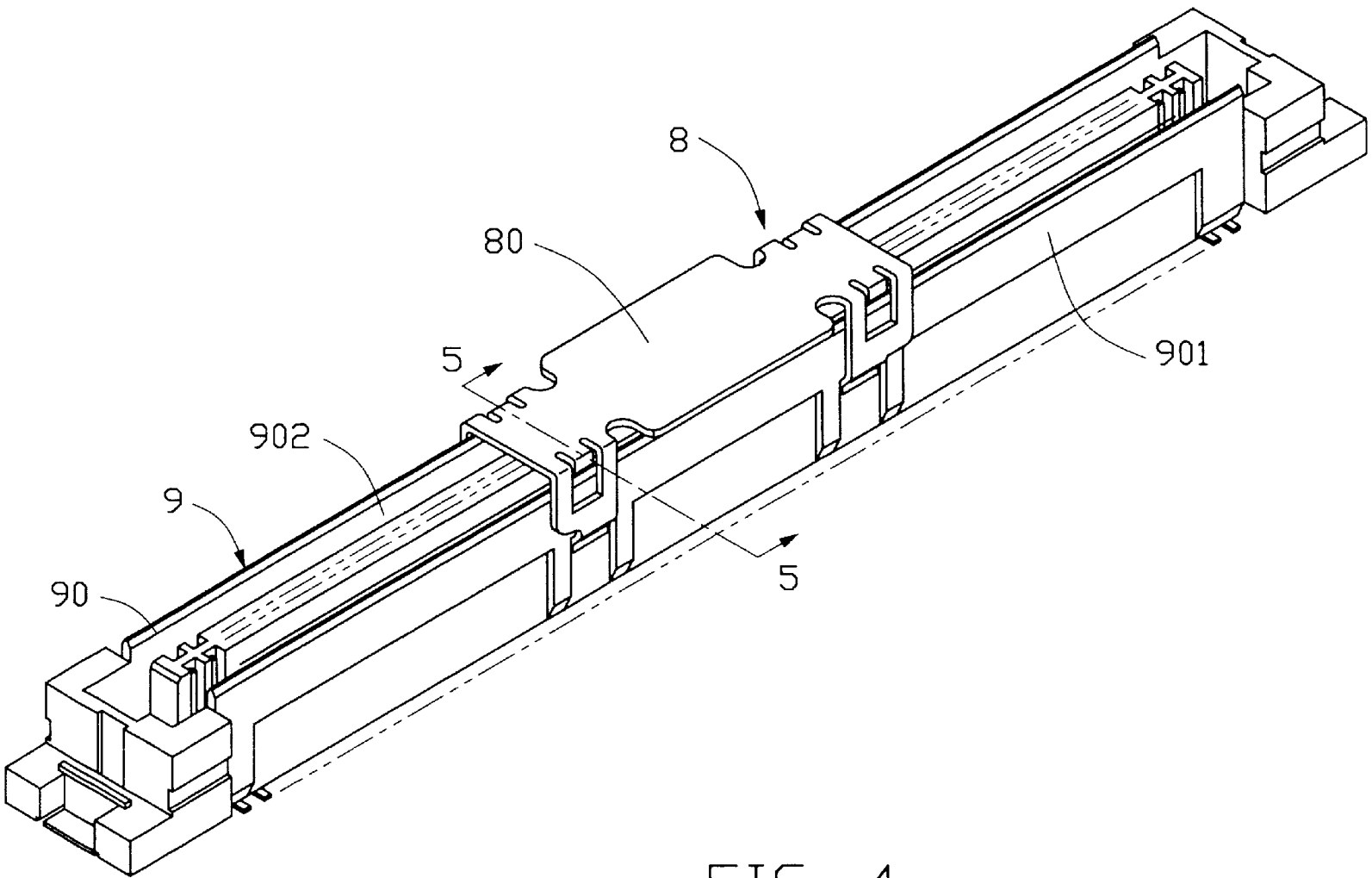
FIG. 4 (PRIOR ART)
FIG. 4 is a perspective view of a conventional connector assembly with a placement member.
Figure 5:
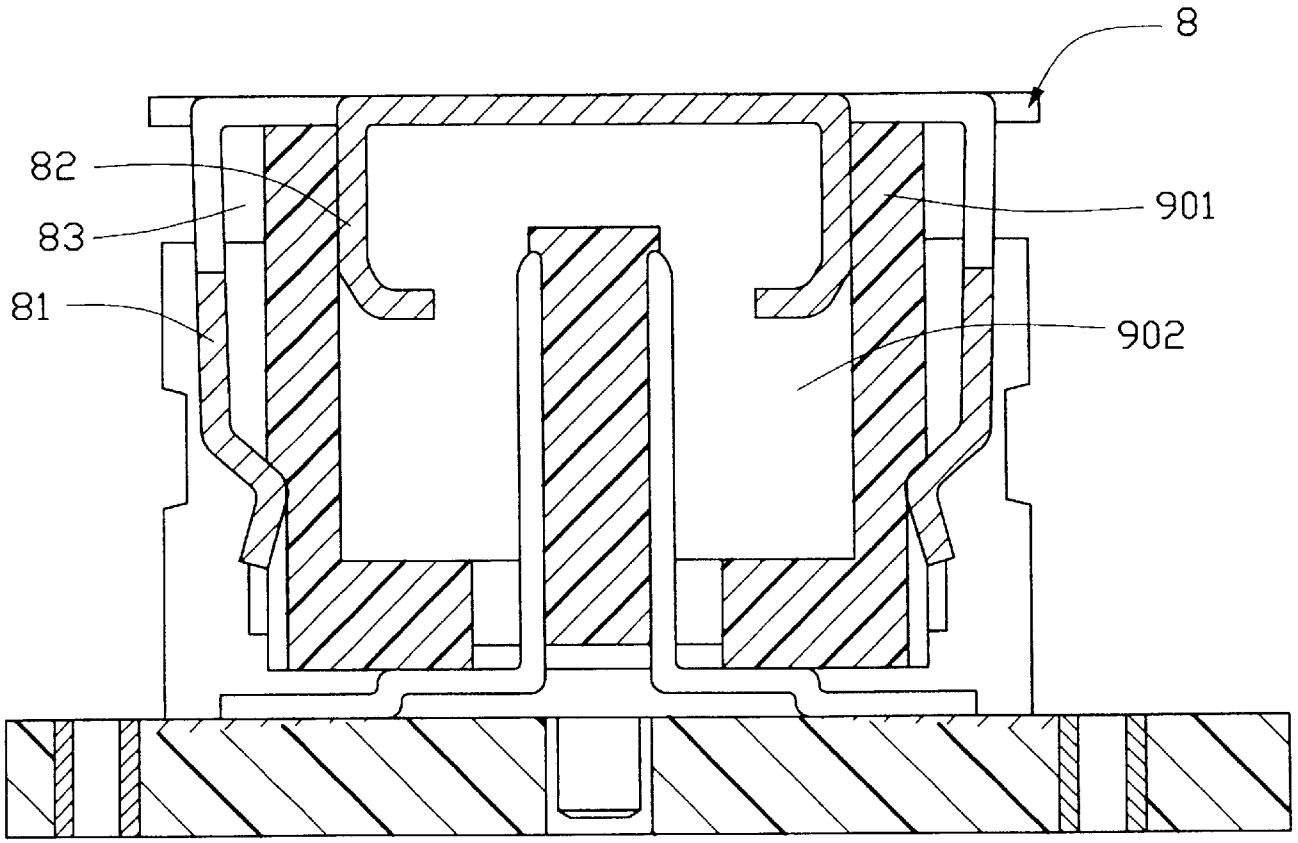
FIG. 5 (PRIOR ART)
FIG. 5 is a cross-sectional view of the electrical connector assembly taken along line 5—5 of FIG. 4.
Figure 6:
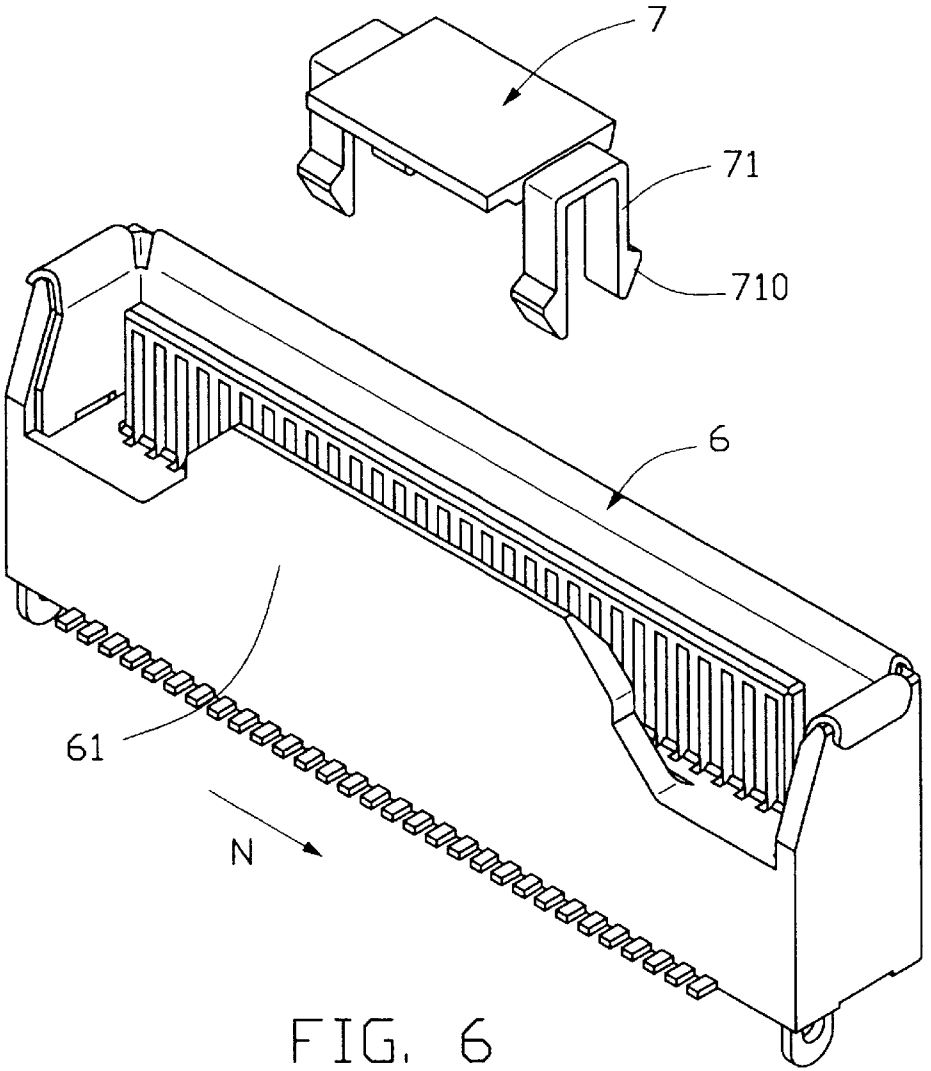
FIG. 6 (RELATED ART)
FIG. 6 is a perspective view of another related art connector assembly with a placement member.

Referring to FIGS. 1–3, a placement member 2 in accordance with the present invention is made of a resilient insulating material, and is attachable to an electrical connector 1.

The connector 1 comprises an insulating body 3 and a plurality of conductive terminals 4. The connector body 3 has an elongate base 30 and a pair of opposing longitudinal sidewalls 31 extending upwardly from respective edges of the base 30. A mating cavity 32 is defined by the sidewalls 31 and the base 30. The mating cavity 32 is intended to receive a mating electrical connector therein (not shown). A plurality of slots 310 are defined in the outer surfaces of the sidewalls 31. The slots 310 are rectangular and extend downwardly and perpendicular to the top edge (not labeled) of each sidewall 31.

A mating rib 33 protrudes upwardly from the base 30 and extends along a center line of the mating cavity 32. A plurality of passageways 330 are defined in opposite sides of the mating rib 33. Contacting portions 41 of an upper end of the terminals 4 are received in the passageways 330 for electrical connection to corresponding terminals of the mating electrical connector (not shown). Each terminal 4 has a soldering portion 42 at a lower end which extends outwardly from the base 30 of the body 3 for being soldered on the printed circuit board (not shown).

The placement member 2 in accordance with the present invention has a main plate 20 which has a substantially planar upper surface 200 to be grasped by a vacuum suction nozzle and an opposite lower surface 201. Two U-shaped retaining portions 21 extend from the two lateral edges of the main plate 20. Each retaining portion 21 has a beam 212 at an upper end, and a pair of projecting legs 210 extending downwardly from opposite ends of the beam 212. A protrusion 211 is formed on an outer surface at a lower end of each projecting leg 210. A distance between outer surfaces of the protrusions 211 on a given retaining portion 21 is a little greater than a distance of between inner surfaces of the connector sidewalls 31, so the projecting legs 210 bend elastically inward when assembled to the connector 3 and abut against the inner surfaces of the sidewalls 31.

A plurality of positioning legs 22 extend downwardly from the lower surface 201 and adjacent to the longitudinal edges of the main plate 20. The positioning legs 22 are parallel to the projecting legs 210. However, a length of the positioning legs 22 is much shorter than a length of the projecting legs 210 and the positioning legs 22 can be received into the slots 310 defined in the outer surface of the connector sidewalls 31.

Referring to FIGS. 1–3, in assembly, the placement member 2 straddles the sidewalls 31 when positioned on the connector 1. The projecting legs 210 project into the mating cavity 32 and the protrusions 211 abut against the inner surfaces of the sidewalls 31. The positioning legs 22 are received in the slots 310. Because of the positioning legs 22, the placement member 2 is assembled on the electrical connector 1 reliably and precisely, and the electrical connector 1 can be grasped reliably by a vacuum suction nozzle and can be placed precisely on the printed circuit board in a preselected position. Furthermore, the placement member 2 is cheaper to manufacture than the metallic placement members of the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for being placed on a printed circuit board by a vacuum suction nozzle, comprising:

an elongate connector body having a base for mounting on the printed circuit board and a pair of opposite longitudinal sidewalls extending upwardly from of the base, a mating cavity defined by the sidewalls and the base;

a plurality of conductive terminals assembled in the connector body; and a placement member made of a resilient insulating material and designed to straddle the longitudinal sidewalls so as to be positioned on the connector body, the placement member comprising a main plate having a substantially planar upper surface adapted to be grasped by the suction nozzle and an opposite lower surface, a plurality of positioning legs extending downwardly from said lower surface and adjacent to a pair of opposite longitudinal edges of the main plate, two U-shaped retaining portions extending from a pair of lateral edges of the main plate, each retaining portion having a beam portion connecting with a corresponding lateral edge of the main plate and a pair of projecting legs extending downwardly from the beam;

wherein said pairs of projecting legs abut against inner surfaces of the sidewalls of the connector body and the positioning legs are positioned on the outer surfaces of said sidewalls, wherein a plurality of slots are defined in the outer surfaces of the sidewalls, at least some of which receive said positioning legs.

2. The electrical connector assembly as described in claim 1, wherein said positioning legs are parallel to said projecting legs.

3. The electrical connector assembly as described in claim 1, wherein a pair of protrusions are formed on respective opposite outer surfaces of said pair of projecting legs and protrude in directions opposite to each other.

4. The electrical connector assembly as described in claim 3, wherein a distance between outer surfaces of the pair of protrusions is greater than a distance between the inner surfaces of the sidewalls of the connector body, so that the projecting legs elastically bend when abutting against inner surfaces of said sidewalls to reliably attach the placement to the connector.

5. The electrical connector assembly as described in claim 1, wherein a mating rib protrudes upwardly from the base, and the conductive terminals are assembled into passageways defined in opposite sides of the mating rib.

6. An electrical connector assembly comprising:

an elongated connector body defining a pair of opposite longitudinal sidewalls with a mating opening therebetween, each of said sidewalls defining opposite inner and outer surfaces;

at least one vertical slot formed in the outer surface of at least one of said sidewalls;

a plurality of terminals disposed in the body;

a placement member including a main plate bridging said opening in a transverse direction;

at least one positioning leg downwardly extending from one longitudinal edge of said main plate;

at least one pair of projecting legs downwardly extending from the main plate;

the projecting legs abutting against the inner surfaces of the side walls, respectively, said at least one positioning leg being received in said slot; wherein the projecting leg has a smaller thickness for increasing resiliency thereof and provides retaining force against the body, while the positioning leg has a larger thickness for increasing strength thereof and assures a true position of said placement member on the body.

7. The electrical connector assembly as described in claim 6, wherein a tip of said positioning leg is tapered in both longitudinal and transverse directions for guidable insertion of the positioning leg into the slot.

* * * * *